US006899303B2

(12) United States Patent
Shams

(10) Patent No.: US 6,899,303 B2
(45) Date of Patent: May 31, 2005

(54) SENSOR FOR RAIL SWITCH POSITION

(75) Inventor: Alireza Shams, East Amherst, NY (US)

(73) Assignee: Introl Design, Inc., Lockport, NY (US)

( * ) Notice: Subject to any disclaimer, the term of this patent is extended or adjusted under 35 U.S.C. 154(b) by 0 days.

(21) Appl. No.: 10/721,149

(22) Filed: Nov. 25, 2003

(65) Prior Publication Data

US 2004/0144896 A1 Jul. 29, 2004

Related U.S. Application Data

(63) Continuation-in-part of application No. 10/231,998, filed on Aug. 30, 2002, now Pat. No. 6,663,053.

(51) Int. Cl.[7] ..... B61L 1/00

(52) U.S. Cl. ..... 246/249; 246/122 R; 324/179; 340/941

(58) Field of Search ..... 246/77, 122 R, 246/167 A, 247, 249, 473.1; 340/941; 324/179, 207.26

(56) References Cited

U.S. PATENT DOCUMENTS

| | | | | |
|---|---|---|---|---|
| 3,697,745 | A | 10/1972 | Bolton | 246/249 |
| 3,721,821 | A | 3/1973 | Blanyer | 246/249 |
| 3,941,338 | A | 3/1976 | Knudsen | 246/247 |
| RE30,012 | E | 5/1979 | Wilkas et al. | 266/246 |
| 4,283,031 | A | 8/1981 | Finch | 246/128 |
| 4,524,932 | A | 6/1985 | Bodziak | 246/247 |
| 4,637,579 | A | 1/1987 | Hartung | 246/452 |
| 5,116,006 | A | 5/1992 | Ocampo | 246/220 |
| 5,192,038 | A | 3/1993 | Ocampo | 246/220 |
| 5,333,820 | A | 8/1994 | Gilcher | 246/249 |
| 5,348,257 | A | 9/1994 | Ocampo | 246/220 |
| 5,395,078 | A | 3/1995 | Gellender | 246/249 |
| 5,628,479 | A | 5/1997 | Ballinger | 246/249 |
| 5,806,809 | A | 9/1998 | Danner | 246/220 |
| 6,371,417 | B1 | 4/2002 | Southon | 246/247 |
| 6,427,949 | B1 | 8/2002 | Hager | 246/220 |

FOREIGN PATENT DOCUMENTS

| | | | |
|---|---|---|---|
| EP | 0002609 | 6/1979 | B61L/29/28 |
| FR | 2494655 | 11/1980 | B61L/1/08 |

*Primary Examiner*—Mark T. Le
(74) *Attorney, Agent, or Firm*—Michael L. Dunn

(57) ABSTRACT

Method and apparatus for detection of the presence of a train wheel on a train track that overcomes problems associated with previously known detectors. The invention includes a method for detecting the presence of a train wheel on a train track. The method includes the steps of: a) generating an electromagnetic field using at least one electromagnetic field generator sensor including a resonance tank circuit; b) providing an electrical charge to the tank circuit when amplitude of the frequency drops below a predetermined level by using a charging circuit; c) providing a feed back from the tank circuit permitting the charging circuit to determine when the amplitude of the frequency has dropped below the predetermined level; d) holding the electromagnetic field generator proximate a train rail so that a train wheel causes a drop in the frequency amplitude below a second threshold level when a train wheel partially affects the field, and so that there frequency amplitude below a third threshold level below the second threshold level when the train wheel is located so that it fully affects the field; e) detecting when there is an increase in frequency amplitude above a first threshold level indicating that the electromagnetic field generator is no longer in a proper position relative to the train rail; f) detecting when there is a change in frequency amplitude relative to the threshold levels; and g) compensating for drift of frequency amplitude between the first and second threshold levels and ceasing such compensating when the frequency amplitude is above the first threshold level or below the second threshold level. The method includes all uses of the detector and apparatus as previously described. The invention further includes apparatus for practicing the method of the invention.

60 Claims, 5 Drawing Sheets

Digital representation of the above analog signals inverted $V_{PV}$ Power-up calibration point/compensation
$V_2$ Point where AUTO Compensation is halted
$V_4$ Point where the rail is out of the field
$V_3$ Point where the rail is detected
$V_1$ Point when the sensor has fallen off the rail
$V_4 - V_3$ = the hysteresis

SENSOR FOR RAIL SWITCH POSITION

This is a continuation-in-part of application Ser. No. 10/231,998 filed Aug. 30, 2002 now U.S. Pat. No. 6,663, 053.

BACKGROUND OF THE INVENTION

Control of trains and their movements along defined rails has been a priority since the inception of railroads. Safety concerns are many including concerns about collisions, derailments, overtaking and colliding with stopped or slower moving trains, head on collisions when trains are traveling on the same rail in opposite directions, improper switch orientation causing trains to enter onto and travel on wrong tracks creating risk of running to the end of the track or colliding with other trains, apparatus or vehicles on the improper track and colliding with road traffic such as cars and trucks at railroad-road crossings. In addition to safety concerns, control of trains is highly desirable for efficient and concentrated use of rail lines. In this regard one of the most important considerations is rail switching and rail switch positions. Improper switch positions can result in collisions, derailments, running through barriers, and running onto sidings causing loss of time in correcting improper train position. In addition to problems associated with improper switch position, incomplete switching can cause the same problems by leaving unacceptable gaps and distances between rails.

There has therefore been a continuing need for automatically detecting rail switch position. Some earlier devices for detecting switch position included electrical contacts between rails that closed when a switch was in a given position, and optical detection systems that detected the presence of a rail of the switch. These systems, while better than no automatic detection systems, had serious disadvantages. In particular contact switches were subject to failure due to wear and due to foreign matter such as soil, stone, and debris that became interposed between switch contacts. Electric contact switches had the further disadvantages of required insulated rails or at least insulated contacts, subject to insulation breakdown and the possibility of grounding out due to conductive articles or substances, e.g. water or even snow, in contact with the rail or contacts.

Another type of switch detector that has been tried is the photoelectric detector. Optical switch detectors were even more susceptible to interference from soil, debris, snow and ice by interference with the clear light path required for proper operation. Such detectors simply do not work well in an environment where dirt or snow can easily block a photodetector and photodetectors are usually sensitive to shock and vibration.

In the prior art, switch position detectors using simple self controlling flux generators having inductance-capacitance tank circuits as sensors were too unreliable for use because of tendency of flux levels and detection levels to drift thus resulting in no reliable standard to use as a basis for comparison when a train wheel entered the flux zone. Such drift resulted from a number of factors including temperature changes that altered component characteristics, presence of iron shavings or powder on the sensors, minor shifting of the sensor relative to the rail, and alteration of characteristics due to component aging. Such flux modification detectors further did not naturally contain reliable fail safe mechanisms indicating when they were operating improperly.

In addition such detectors are generally unreliable, for reasons previously stated, and are often costly and complex due to attempts to overcome the disadvantages previously described. A number of such patents in the somewhat related area of wheel detection, require both a field generator, such as a coil or permanent magnet and at least one detection coil that detects a change in flux density when a wheel flange approaches the coils. The use of both a field generator and a detection coil, or other multiple coil systems not only increases cost and complexity, the detectors are not as sensitive as desired. Examples of patents using multiple coils and or permanent magnets include U.S. Pat. Nos. Re 30,012; 3,697,745; 4,283,031; 4,524,932; 5,333,820; 5,628, 479 and European Patent Application 0 002 609. Other systems, e.g. have employed the use of phase shift in an attempt to detect the presence of a train wheel. Such systems are subject to interference and are complex, e.g. as described in U.S. Pat. Nos. 5,395,078 and 3,721,821. A number of systems do not provide for compensation due to environmental factors and component aging, e.g. as described in U.S. Pat. No. 3,941,338, and still others use complex and unreliable circuitry where a microprocessor or other device is used to provide frequency generation that is then fed into a tank circuit, rather than relying upon a tank circuits own natural frequency. Examples of such patents include U.S. Pat. No. 6,371,417 and French patent application 80 25496.

Up to now, no known system has had the desired combination of properties of simplicity; reliability, including compensation; and fail safe detection of switch position, afforded by the apparatus and method of the present invention.

BRIEF DESCRIPTION OF THE INVENTION

Figure 1:
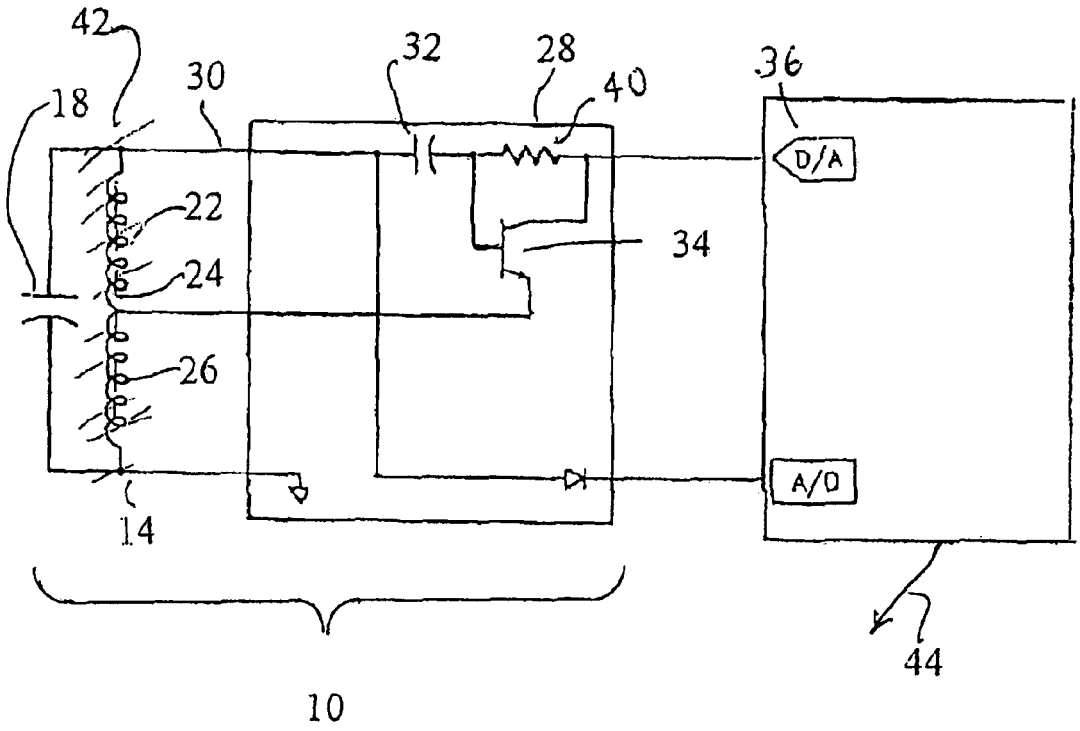
FIG. 1 is combined circuit block diagram showing a preferred embodiment of detector circuitry of the invention.

In accordance with the invention, method and apparatus are provided for detection of switch position on a train track that overcomes problems associated with previously known detectors. In particular, the method and apparatus of the present invention take advantage of all of the good characteristics of a self controlling tank circuit while only using microprocessor intervention when necessary to calibrate the tank circuit, prevent drift, provide fail safe information and record and transmit information. The method and apparatus are thus highly reliable but simpler in design than those previously known.

The invention includes a method for detecting position of a railway switch, between a normal closed position and a reverse closed position. The switch includes first and second essentially continuous stationary external rails and first and second discontinuous moveable internal rails within a surface area defined by the external rails.

The external rails are parallel to each other on one side of the switch and diverge from each other on an opposing side of the switch.

The first moveable internal rail is essentially parallel to the first stationary external rail and the second moveable internal rail is essentially parallel to the second stationary external rail. The moveable internal rails cross each other and for that purpose are provided with rail gaps at the rail crossing to permit passage of a train wheel flange over one of the internal rails when a train wheel is traveling on the other internal rail. Each of the internal rails is provided with a point contact end such that the first internal rail diverts a train wheel to the first internal rail when its point contact is in contact with a corresponding contact point on the second external rail and the second internal rail diverts a train wheel to the second internal rail from the first external rail when its point contact is in contact with a corresponding contact point on the first external rail.

The method of the invention includes the steps of:

a) generating an electromagnetic field using at least one electromagnetic field generator sensor including: an inductance-capacitance (L/C) loop tank circuit that develops an alternating current at a natural resonance frequency to provide an electromagnetic field when the L/C tank circuit is electrically charged;

b) providing an electrical charge to the tank circuit when amplitude of the frequency drops below a predetermined level using a charging circuit;

c) providing a feed back from the tank circuit to the charging circuit at the resonance frequency permitting the charging circuit to determine when the amplitude of the frequency has dropped below the predetermined level where the L/C tank circuit and charging circuit are incapable of maintaining the predetermined amplitude of the frequency when a ferromagnetic material of the mass of the rail of a train switch is located in a center of the field;

d) positioning the electromagnetic field generator proximate at least a first of the contact points on a rail of said switch so that the electromagnetic field extends through a spatial area through which its corresponding contact point on another rail moves relative to the first contact point during approach or recession of the corresponding contact point to or from the first contact point, so that the field is affected to cause a drop in the frequency amplitude below a second threshold level that is below the predetermined level when corresponding rails are sufficiently close to safely permit passage of a train and so that there is a further drop in frequency amplitude below a third threshold level below the second threshold level when the corresponding rails are sufficiently close so that the affect of the second rail upon the field is maximized.;

e) detecting when there is an increase in frequency amplitude above a first threshold level above the predetermined level indicating that the electromagnetic field generator is no longer in a proper position relative to the first contact point;

f) detecting the drop in frequency amplitude below the second threshold level to indicate approach and relative positions of corresponding rails;

g) detecting the drop in frequency amplitude below the third threshold level to indicate that the first contact point and its corresponding contact point are separated by less than 0.1 inch; and h) compensating for drift of frequency amplitude from the predetermined level when the drift is between the first and second threshold levels and ceasing such compensating when the frequency amplitude is above the first threshold level or below the second threshold level.

The method includes all uses of the detector and apparatus as previously described.

The invention further includes apparatus for practicing the method of the invention.

DETAILED DESCRIPTION OF THE INVENTION

In accordance with the invention, the detector of the invention includes at least one self controlling electromagnetic field generator sensor including a inductance-capacitance (L/C) tank circuit, i.e. a capacitance and inductance in series or parallel (preferably parallel) where an electrical charge continuously alternatively resonates at its own natural frequency between charging and discharging the capacitor and charging and discharging an inductor creating an alternating current within the tank circuit and a surrounding alternating electromagnetic flux. "Self controlling, as used herein, means that natural resonance frequency of the tank circuit is used to generate an electromagnetic flux field and that the tank circuit is electrically charged only when feedback from the tank circuit to an analog transistor circuit indicates that frequency amplitude has dropped to a sufficient level (predetermined level) to require that the tank circuit be recharged. Such a circuit is exceedingly reliable and simple and does not attempt to fight or overcome the natural properties of the tank circuit as occurs in prior art flux detectors.

The inductance in the inductance-capacitance (L/C) tank circuit is preferably a ferrite material core surrounded by an insulated radially wound electrically conductive wire that provides a sufficient inductance to operate in conjunction with the capacitance to form the alternating current at the natural resonance frequency of the tank circuit to provide the electromagnetic field when the L/C tank circuit is electrically charged. The presence of the ferrite material core increases flux density. The ferrite core used in accordance with the present invention is preferably a core having a ring shaped indentation or depression (referred to herein as "concave"). Such a configuration permits formation of a directional flux field so that a rail to which a detector of the sensor is mounted will have little or no affect upon frequency amplitude of the field.

A charging circuit is provided that provides an electrical charge to the tank circuit when amplitude of the frequency drops below a predetermined level. The charging circuit is controlled by feed back from the tank circuit to the charging circuit at the resonance frequency permitting the charging circuit to determine when the amplitude of the tank circuit frequency has dropped below the predetermined level thus causing the charging circuit to recharge the tank circuit. In a preferred embodiment, the charging circuit includes a switch having a transistor that is activated by feed back from the tank circuit to the base of the transistor to permit charging of the tank circuit when amplitude of the frequency drops below the predetermined level.

The predetermined level is preferably between 70 and 85 percent of the voltage available to drive the charging circuit. The predetermined level is usually from about 3.5 to about 6 volts. In a preferred embodiment, in order to permit the predetermined level to be below the voltage available to drive the charging circuit, a resistance is provided between the collector and base of the transistor. Transistors, as well as other electronic components, have operating curves that are not ideal, that is they do not operate linearly over their entire range of operation. Transistors are usually operated in their linear range and great effort is often expended to accomplish that goal. In the present invention, it has nevertheless been surprisingly found that the transistor should be operated near its current saturation point, at an exponential portion of its operating curve so that minor changes in flux density around the tank circuit do not translate to large changes in frequency amplitude. It has thus been found that the value of the resistance is preferably controlled such that the ratio of the resistance to the inductance of the tank circuit is from about 1:20 to about 1:40 ohms to mH to control sensitivity of the detector, otherwise minor fluctuations in flux density can result in large changes in frequency amplitude thus increasing risk of false positive detection of proximity of a switch rail.

The L/C tank circuit and charging circuit are of insufficient power to maintain the predetermined amplitude of the frequency when a ferromagnetic material of the mass of a train rail is located in a center of the field. The field thus at least partially collapses in the presence of the ferromagnetic mass of a train rail so that there is a detectable drop in the amplitude of the frequency below the predetermined amplitude.

It should also be understood that the field is partially dampened by the ferromagnetic material of a train rail thus an increase in frequency amplitude above a first threshold level above and at a fixed difference from the predetermined level indicates that the electromagnetic field generator is no longer in a proper position relative to the train rail. Detecting such a rise in frequency amplitude is a fail safe mechanism that again takes advantage of the natural characteristics of the tank circuit without the need for other complex mechanisms to determine dislodgment of the sensor.

Apparatus is provided for holding the electromagnetic field generator proximate at least a first of the contact points on a rail of the switch so that the electromagnetic field extends through a spatial area through which its corresponding contact point on another rail moves relative to the first contact point during approach or recession of the corresponding contact point to or from the first contact point. During such movement, the field is affected to cause a drop in the frequency amplitude below a second threshold level that is below the predetermined level when corresponding rails are sufficiently close to safely permit passage of a train and so that there is a further drop in frequency amplitude below a third threshold level below the second threshold level when the corresponding rails are sufficiently close so that the affect of the second rail upon the field is maximized.

Apparatus, usually in the form of a microprocessor, is provided for recognizing an increase in frequency amplitude above a first threshold level above the predetermined level indicating that the electromagnetic field generator is no longer in a proper position relative to the first contact point on the train rail. Such apparatus also recognizes the drop in frequency amplitude below the second threshold level to indicate approach and relative positions of corresponding rails, and for detecting the drop in frequency amplitude below the third threshold level to indicate that the first contact point and its corresponding contact point are separated by less than 0.1 inch.

Apparatus is also provided for compensating for drift of frequency amplitude from the predetermined level to obtain a new adjusted predetermined level when the drift is between the first and second threshold levels and for ceasing such compensating when the frequency amplitude is above the first threshold level or below the second threshold level. "Drift" as used herein means a slow change in frequency amplitude, as opposed to an abrupt change. A slow change is considered to be a change that occurs in small increments over a long period, e.g. less than one percent change in fifteen seconds. Such compensating apparatus may also be in the form of a microprocessor and may be the same microprocessor measuring, recording and comparing changes in amplitude to determine the presence and distance from another a train rail. The apparatus for compensating for drift provides compensation to the transistor to prevent drift by the switch, in providing of charging of the tank circuit, when amplitude of the frequency varies from the predetermined level between the first and second thresholds.

The charging circuit is adjusted by the microprocessor to compensate for temperature changes, for accumulation of metal shavings or other minor metal materials near the inductance-capacitance (L/C) loop tank circuit and for aging of electronic components and the compensation is halted by the microprocessor when a train rail, moving relatively toward a sensor, partially affects the field so that the frequency amplitude drops below the second threshold value.

The detector may also contain a memory containing stored information on temperature affects upon each specific sensor and apparatus for measuring temperature in an environment around the sensor so that the microprocessor can adjust output from a sensor by comparing measured temperature with the stored information.

The detector also includes apparatus for measuring frequency amplitude upon power up and uses resulting power up information to adjust voltage applied to the transistor until the predetermined frequency amplitude, usually at from about 4 to about 6 volts, is obtained. Again, the apparatus may be a microprocessor and may be the same microprocessor used for measuring, recording and comparing changes in amplitude to determine the position of a train rail and to compensate for drift.

In the same way, the frequency amplitude may be continuously monitored and compared with power up information and the difference used to determine dislocation or misalignment of sensors and a fail safe signal output may be initiated by the microprocessor when a positive difference determined by subtracting the power up information from the monitored frequency amplitude exceeds the first threshold level.

Electromagnetic field generators may operate independently at different natural resonance frequencies so that drops in frequency amplitude can be measured with respect to each field generator sensor without interference from the other field generator sensors.

Movement of a rail within a flux field provided by the sensors, permits measurement of multiple states of frequency amplitude including a state corresponding to no detection of a rail, a state corresponding to initial positive detection of the rail, states corresponding to multiple different gap distances of a contact point from its corresponding rail and the state where a contact point is as close as possible within a switch mechanism to its corresponding rail.

The method includes all uses of the detector apparatus as previously described.

The method and detector of the invention can be further understood by reference to the drawings depicting a preferred embodiment of the invention.

As best seen in FIG. 1 a field generator sensor 10 includes a self controlling electromagnetic field generator 14 in the form of a tank circuit having a capacitor 18 in parallel with inductor 22. The inductor is provided with a ferrite metal core 24, preferably in the form of a pot core, surrounded by an insulated radially wound electrically conductive wire 26 for operation in conjunction with capacitor 18 to form a resonant tank circuit that naturally operates at a given frequency. Similar field generators may be used in detectors of the invention that have similar but different frequencies due to slightly different capacitance or inductance values. The tank circuit 14 provides an electromagnetic field at its natural frequency when charged.

Charging circuits 28 provides an electrical charge to the tank circuits 14.

The charging circuit 28 is controlled by feed back from tank circuit 14 through line 30 and capacitor 32. The charging circuit includes a switch in the form of transistor 34 that is activated by feed back from the tank circuit to the bases of the transistor so that when the amplitude of the frequency drops below a predetermined level of about 5 volts determined by the value of the capacitance, resistance and specifications of the transistor and available voltage from digital to analog converters 36, the transistor is activated to permit charging from the transistor to the coil 26 of inductor 22. The predetermined level is between 70 and 85 percent of the voltage available from digital to analog converter 36 that may be an integral part of microprocessor 38.

In order to permit the predetermined level to be below the voltage available from the microprocessor to drive the charging circuit 10, a resistance 40 is provided between the base and collector of the transistor. Resistance 40 is selected to permit the transistor to operate near its current saturation point, e.g. between 80 and 95 percent of saturation. This permits a change in flux density around the tank circuit that is less than created by the mass of a ferromagnetic train rail to be disregarded. The resistance is typically between 75 k ohms and 150 k ohms.

Figure 4:
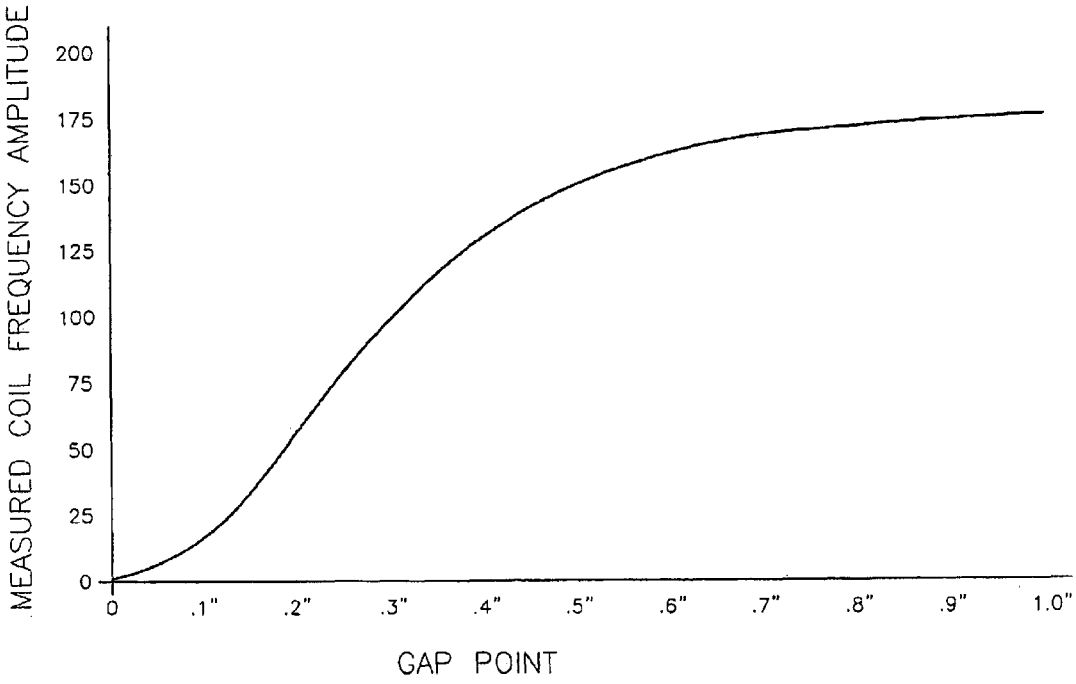
FIG. 4 shows a curve of change in frequency amplitude as switch gap increases.

The L/C tank circuit 14 operates at insufficient power to maintain the amplitude of the frequency when a ferromagnetic mass the size of a train rail is located in the center of the field 42 developed by the circuit. The field thus at least partially collapses in the presence of a ferromagnetic mass the size of a train rail so that there is a detectable drop in amplitude. When the train rail enters the field as shown by the gap point width positions shown in FIG. 4, representing frequency amplitude when a train rail first enters the field (e.g. at about one inch gap width), the frequency amplitude begins to drop. When the rail is directly centered in the tank circuit (e.g. gap width about 0), the frequency amplitude drops to essentially zero.

Figure 3A:
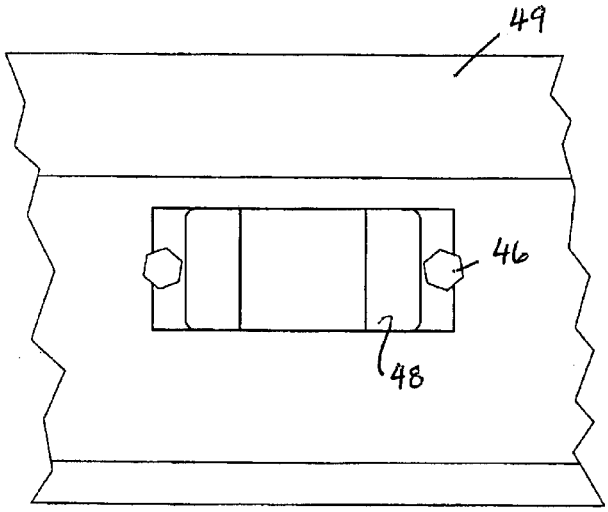
FIG. 3*a* shows a front view of a detector of the invention mounted to a train rail.
Figure 3B:
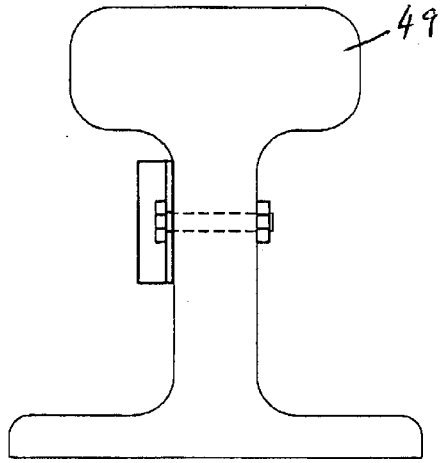
FIG. 3*b* shows a cross sectional end view of a detector of the invention mounted to a train rail.
Figure 5:
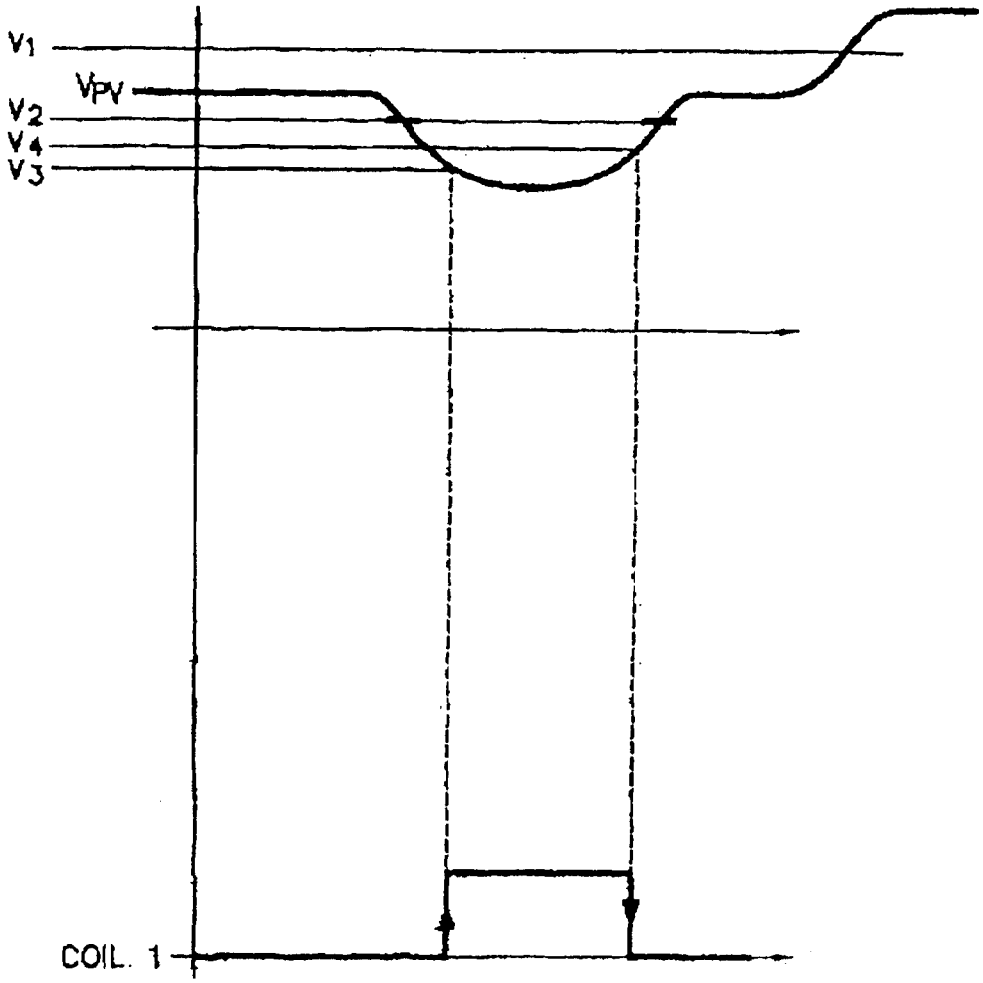
FIG. 5 shows a curve of frequency amplitude depending upon switch rail position.

When the detector is mounted near a train rail, as shown in FIGS. 3*a* and 3*b*, the rail dampens the frequency amplitude to the predetermined level thus if the detector is dislodged from the rail, there will be a spike in frequency amplitude represented by first threshold level $V_1$ as shown in FIG. 5. Microprocessor 38 can then recognize the spike above threshold level one and sent a warning signal through output 44.

The detector 10, including the sensors, charging circuits and accompanying microprocessor in a water tight package 48, are held to the rails 49 by bolts 46 as seen in FIGS. 3*a* and 3*b* so that the field 42 extends through a spatial area 50, 50*a* through which a train rail moves so that the field is affected to cause a drop in the frequency amplitude below a second threshold level $V_2$ that is below and at a fixed difference from the predetermined level $V_{pV}$ as shown in FIG. 4 when a train rail is located in the spatial area 52, 52*a* so that it partially affects the field and so that there is a further drop in frequency amplitude below a third threshold level $V_3$ below and at a fixed difference from the second threshold level when the train rail 52, 52*a* is located directly at the sensor. When the train rail 52, 52*a* moves away from the sensor, the frequency amplitude again increases to the predetermined level and passage of the train rail from the special area can be recognized at a fourth threshold level $V_4$ just below the predetermined level. Microprocessor 38 recognizes the changes in frequency amplitude relative to the threshold levels and provides information to exterior devices through output 44 based thereon as previously described.

The microprocessor also compensates for drift in the predetermined level and makes adjustments to obtain a new adjusted predetermined level by providing variation to the supply voltage to the transistors as previously described both during power up and during operation.

Figure 2:
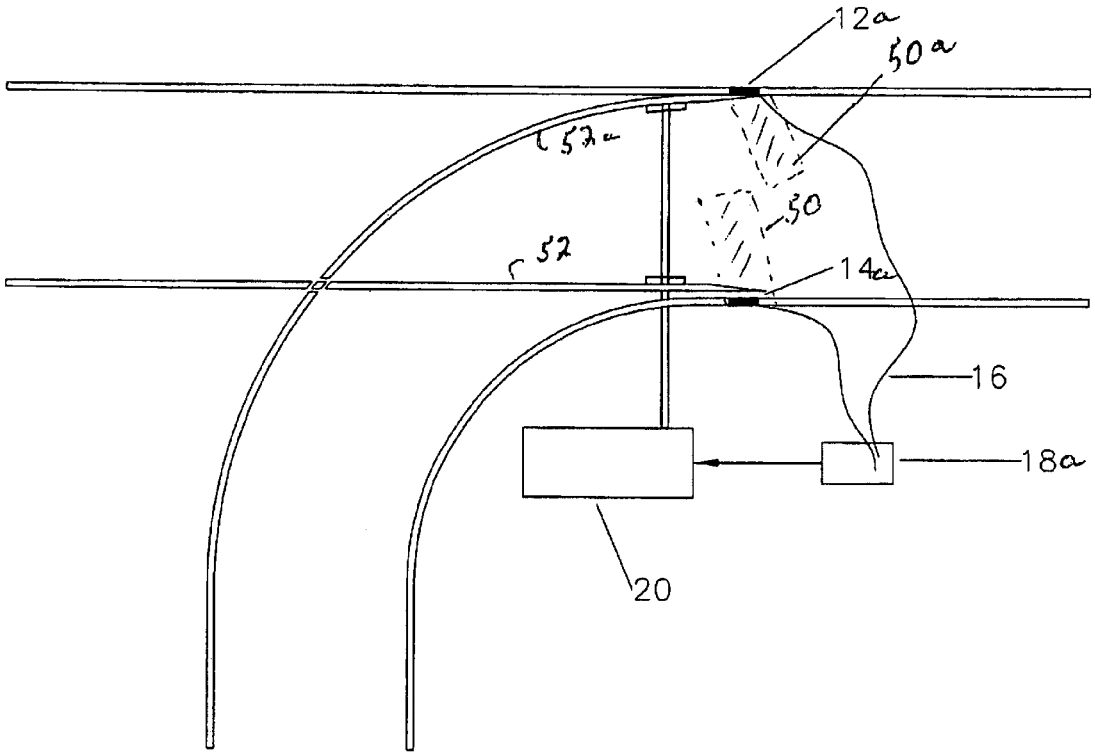
FIG. 2 shows a railroad track system incorporating detectors of the invention.

As seen in FIG. 2, a plurality of sensors can be used for detecting closed, gap and open positions in the normal and reverse orientations. Signals, such as warning or switch position signals can be sent through line 44 depending upon switch position. As seen in FIG. 2, a controller 18*a* receives signals from sensors 12*a* and 14*a* through lines 16 which in turn can control switch mechanism 20 to alter switch position or provide an exterior signal so that switch mechanism 20 can be manually or otherwise activated.

What is claimed is:

1. A detector for position of a railway switch, between a normal closed position and a reverse closed position, which switch includes first and second essentially continuous stationary external rails and first and second discontinuous internal rails within a surface area defined by the external rails, said external rails being parallel to each other on one side of the switch and diverging from each other on an opposing side of the switch; a first moveable internal rail of said internal rails being essentially parallel to the first stationary external rail and a second moveable internal rail of said internal rails being essentially parallel to the second stationary external rail, said moveable internal rails crossing each other and being provided with rail gaps at the rail crossing to permit passage of a train wheel flange over one of the internal rails when a train wheel is traveling on the other internal rail, each of the internal rails being provided with a point contact end such that the first internal rail diverts a train wheel to the first internal rail when its point contact is in contact with a corresponding contact point on the second external rail and the second internal rail diverts a train wheel to the second internal rail from the first external rail when its point contact is in contact with a corresponding contact point on the first external rail, said detector comprising at least one sensor including:

i) at least one electromagnetic field generator sensor comprising: a inductance-capacitance (L/C) loop tank circuit that develops an alternating current at a natural resonance frequency to provide an electromagnetic field when the L/C tank circuit is electrically charged; a charging circuit that provides an electrical charge to the tank circuit when amplitude of the frequency drops below a predetermined level; and a feed back from the tank circuit to the charging circuit at the resonance frequency permitting the charging circuit to determine when the amplitude of the frequency has dropped below the predetermined level; said L/C tank circuit and charging circuit being incapable of maintaining the predetermined amplitude of the frequency when a ferromagnetic material of the mass of the rail of a train switch is close enough to the sensor to be located in a center of the field;

ii) at least one means for positioning the electromagnetic field generator proximate at least a first of the contact points on a rail of said switch so that the electromagnetic field extends through a spatial area through which its corresponding contact point on another rail moves relative to the first contact point during approach or recession of the corresponding contact point to or from the first contact point, so that the field is affected to cause a drop in the frequency amplitude below a second threshold level that is below the predetermined level when corresponding rails are sufficiently close to safely permit passage of a train and so that there is a further drop in frequency amplitude below a third threshold level below the second threshold level when the corresponding rails are sufficiently close so that the affect of the second rail upon the field is maximized;

iii) at least one means for detecting an increase in frequency amplitude above a first threshold level above the predetermined level indicating that the electromagnetic field generator is no longer in a proper position relative to the first contact point, for detecting the drop in frequency amplitude below the second threshold level to indicate approach and relative positions of corresponding rails, and for detecting the drop in frequency amplitude below the third threshold level to indicate that the first contact point and its corresponding contact point are separated by less than 0.1 inch; and iv) a means for compensating for drift of frequency amplitude from the predetermined level when the drift is between the first and third threshold levels and for ceasing such compensating when the frequency amplitude is above the first threshold level or below the second threshold level.

2. The detector of claim 1 wherein one sensor is located proximate at least one of the corresponding contact points on the first internal and second external rails, and another sensor is located on at least one of the corresponding contact points on the second internal and first external rails.

3. The detector of claim 2 wherein one sensor is located proximate the contact point on the first internal rail, and another sensor is located proximate the contact point on the second internal rail, said external rails being stationary relative to the earth but moveable through the fields relative to the internal rails.

4. The detector of claim 2 wherein one sensor is located proximate the contact point on the first external rail, and another sensor is located proximate the contact point on the second external rail.

5. The detector of claim 1 wherein the field generator comprises a directional ferrite pot core coil.

6. The detector of claim 1 further comprising a processing module for comparing predetermined levels and threshold levels of the sensors to determine status of switch position.

7. The detector of claim 6 where the processing module comprises a microprocessor.

8. The detector of claim 1 wherein the charging circuit comprises an electronic switch having a transistor that is activated by means of feed back from the tank circuit to the base of the transistor to permit charging of the tank circuit when amplitude of the frequency drops below the predetermined level.

9. The detector of claim 8 wherein the means for compensating for drift is a means for providing compensation to the transistor to prevent drift by the switch, in providing of charging of the tank circuit, when amplitude of the frequency drops below the predetermined level.

10. The detector of claim 8 wherein the predetermined level is between 70 and 85 percent of the voltage available to drive the charging circuit.

11. The detector of claim 10 where a resistance is provided between the collector and base of the transistor to permit the predetermined level to be below the voltage available to drive the charging circuit.

12. The detector of claim 11 wherein the ratio of the resistance of the resistor to the inductance of the tank circuit is from about 1:20 to about 1:40 ohms to mH to control sensitivity of the detector.

13. The detector of claim 10 wherein the predetermined level is from about 3.5 to about 6 volts.

14. The detector of claim 1 wherein the inductance-capacitance (L/C) loop tank circuit comprises a directional inductor in the form of a pot core comprising a concave ferrite material core wound with an insulated electrically conductive wire that provides a sufficient inductance to operate in conjunction with the capacitance to form the alternating current at the natural resonance frequency to provide the electromagnetic field when the L/C tank circuit is electrically charged.

15. The detector of claim 1 wherein a microprocessor measures and records the change in amplitude and compares the change with preprogrammed and stored threshold values to determine switch position.

16. The detector of claim 2 wherein a microprocessor measures and records the change in amplitude and compares the change with preprogrammed and stored threshold values to determine switch position.

17. The detector of claim 15 wherein the output of the charging circuit is adjusted by the microprocessor to compensate for temperature changes and for accumulation of metal shavings near the inductance-capacitance (L/C) loop tank circuit and the compensation is halted by the microprocessor when a rail moving relatively toward a sensor, partially affects the field so that the frequency amplitude drops below the second threshold value.

18. The detector of claim 17 wherein the detector contains a memory containing information on temperature affects upon each specific sensor and a means for measuring temperature in an environment around the sensor and the microprocessor adjusts output from a sensor by comparing measured temperature with said information.

19. The detector of claim 2 wherein both electromagnetic field generators operate independently at different natural resonance frequencies so that drops in frequency amplitude can be measured with respect to each field generator sensor without interference from the other field generator sensor.

20. The detector of claim 16 wherein the microprocessor compares change in amplitude with an internal library of amplitudes representing various positions of a contact point relative to a corresponding rail.

21. The detector of claim 17 wherein the microprocessor compares change in amplitude with an internal library of amplitudes representing various positions of contact points relative to corresponding rails between a completely closed normal switch position and a completely closed reverse switch position.

22. The detector of claim 7 wherein the microprocessor measures frequency amplitude upon power up and uses resulting power up information to compensate for position of field generator sensors.

23. The detector of claim 16 wherein the microprocessor measures frequency amplitude upon power up and uses resulting power up information to compensate for position of field generator sensors.

24. The detector of claim 22 wherein frequency amplitude is continuously monitored and compared with power up information and the difference is used to determine dislocation or misalignment of sensors.

25. The detector of claim 23 wherein frequency amplitude is continuously monitored and compared with power up information and the difference is used to determine dislocation or misalignment of sensors.

26. The detector of claim 24 where a fail safe signal output is initiated by the microprocessor when a positive difference determined by subtracting the power up information from the monitored frequency amplitude exceeds a fail safe threshold level.

27. The detector of claim 25 where a fail safe signal output is initiated by the microprocessor when a positive difference determined by subtracting the power up information from the monitored frequency amplitude exceeds a fail safe threshold level.

28. A method for detecting for position of a railway switch comprising using the detector of claim 1.

29. A method for detecting for position of a railway switch, between a normal closed position and a reverse closed position, which switch includes first and second essentially continuous stationary external rails and first and second discontinuous internal rails within a surface area defined by the external rails, said external rails being parallel to each other on one side of the switch and diverging from each other on an opposing side of the switch; a first moveable internal rail of said internal rails being essentially parallel to the first stationary external rail and a second moveable internal rail of said internal rails being essentially parallel to the second stationary external rail, said moveable internal rails crossing each other and being provided with rail gaps at the rail crossing to permit passage of a train wheel flange over one of the internal rails when a train wheel is traveling on the other internal rail, each of the internal rails being provided with a point contact end such that the first internal rail diverts a train wheel to the first internal rail when its point contact is in contact with a corresponding contact point on the second external rail and the second internal rail diverts a train wheel to the second internal rail from the first external rail when its point contact is in contact with a corresponding contact point on the first external rail, said method comprising the steps of:

a) generating an electromagnetic field by means of at least one electromagnetic field generator sensor comprising: a inductance-capacitance (L/C) loop tank circuit that develops an alternating current at a natural resonance frequency to provide an electromagnetic field when the L/C tank circuit is electrically charged;

b) providing an electrical charge to the tank circuit when amplitude of the frequency drops below a predetermined level by means of a charging circuit;

c) providing a feed back from the tank circuit to the charging circuit at the resonance frequency permitting the charging circuit to determine when the amplitude of the frequency has dropped below the predetermined level where the L/C tank circuit and charging circuit are incapable of maintaining the predetermined amplitude of the frequency when a ferromagnetic material of the mass of the rail of a train switch is located in a center of the field;

d) positioning the electromagnetic field generator proximate at least a first of the contact points on a rail of said switch so that the electromagnetic field extends through a spatial area through which its corresponding contact point on another rail moves relative to the first contact point during approach or recession of the corresponding contact point to or from the first contact point, so that the field is affected to cause a drop in the frequency amplitude below a second threshold level that is below the predetermined level when corresponding rails are sufficiently close to safely permit passage of a train and so that there is a further drop in frequency amplitude below a third threshold level below the second threshold level when the corresponding rails are sufficiently close so that the affect of the second rail upon the field is maximized;

e) detecting when there is an increase in frequency amplitude above a first threshold level above the predetermined level indicating that the electromagnetic field generator is no longer in a proper position relative to the first contact point;

f) detecting the drop in frequency amplitude below the second threshold level to indicate approach and relative positions of corresponding rails;

g) detecting the drop in frequency amplitude below the third threshold level to indicate that the first contact point and its corresponding contact point are separated by less than 0.1 inch; and h) compensating for drift of frequency amplitude from the predetermined level when the drift is between the first and second threshold levels and ceasing such compensating when the frequency amplitude is above the first threshold level or below the second threshold level.

30. The method of claim 29 further comprising locating one sensor proximate at least one of the corresponding contact points on the first internal and second external rails, and locating another sensor on at least one of the corresponding contact points on the second internal and first external rails.

31. The method of claim 30 comprising locating one sensor proximate the contact point on the first internal rail, and locating another sensor proximate the contact point on the second internal rail, said external rails being stationary relative to the earth but moveable through the fields relative to the internal rails.

32. The method of claim 30 further comprising locating one sensor proximate the contact point on the first external rail, and locating another sensor proximate the contact point on the second external rail.

33. The method of claim 29 comprising using a field generator comprising a directional ferrite pot core coil.

34. The method of claim 29 further comprising using a processing module for comparing predetermined levels and threshold levels of the sensors to determine status of switch position.

35. The method of claim 34 further comprising using a processing module comprises a microprocessor.

36. The method of claim 29 wherein a switch in the charging circuit comprises a transistor that is activated by means of feed back from the tank circuit to the base of the transistor to permit charging of the tank circuit when amplitude of the frequency drops below the predetermined level.

37. The method of claim 30 wherein a switch in the charging circuit comprises a transistor that is activated by means of feed back from the tank circuit to the base of the transistor to permit charging of the tank circuit when amplitude of the frequency drops below the predetermined level.

38. The method of claim 36 wherein the predetermined level is between 70 and 85 percent of voltage available to drive the charging circuit.

39. The method of claim 36 comprising providing a resistance between the collector and base of the transistor to permit the predetermined level to be below the voltage available to drive the charging circuit.

40. The method of claim 39 wherein the ratio of the resistance to the inductance of the tank circuit is from about 1:20 to about 1:40 ohms to mH to control sensitivity of the detector.

41. The method of claim 38 wherein the predetermined level is from about 3.5 to about 6 volts.

42. The method of claim 29 comprising using an inductance-capacitance (L/C) loop tank circuit that comprises a directional inductor in the form of a pot core comprising a concave ferrite material core surrounded by an insulated radially wound electrically conductive wire that provides a sufficient inductance to operate in conjunction with the capacitance to form the alternating current at the natural resonance frequency to provide the electromagnetic field when the L/C tank circuit is electrically charged.

43. The method of claim 30 comprising using an inductance-capacitance (L/C) loop tank circuit that comprises a directional inductor in the form of a pot core comprising a concave ferrite material core surrounded by an insulated radially wound electrically conductive wire that provides a sufficient inductance to operate in conjunction with the capacitance to form the alternating current at the natural resonance frequency to provide the electromagnetic field when the L/C tank circuit is electrically charged.

44. The method of claim 29 wherein a microprocessor is used to measure and record the change in amplitude and compares the change with preprogrammed and stored threshold values to determine switch position.

45. The method of claim 30 wherein a microprocessor is used to measure and record the change in amplitude and compares the change with preprogrammed and stored threshold values to determine switch position.

46. The method of claim 44 wherein the output of the charging circuit is adjusted by the microprocessor to compensate for affects of temperature changes upon the inductance-capacitance (L/C) loop tank circuit and the compensation is halted by the microprocessor when a rail moving relatively toward a sensor, partially affects the field so that the frequency amplitude drops below the second threshold value.

47. The method of claim 46 wherein the detector contains a memory containing information on temperature affects upon each specific sensor and a means for measuring temperature in an environment around the sensor and the microprocessor adjusts output from a sensor by comparing measured temperature with said information.

48. The method of claim 44 wherein the output of the charging circuit is adjusted by the microprocessor to compensate for accumulation of metal shavings near the inductance-capacitance (L/C) loop tank circuit and the compensation is halted by the microprocessor when a rail moving relatively toward a sensor, partially affects the field so that the frequency amplitude drops below the second threshold value.

49. The method of claim 30 wherein both electromagnetic field generators operate independently at different natural resonance frequencies.

50. The method of claim 44 wherein the microprocessor compares change in amplitude with an internal library of amplitudes representing various positions of a contact point relative to a corresponding rail.

51. The method of claim 45 wherein the microprocessor compares change in amplitude with an internal library of amplitudes representing various positions of contact points relative to corresponding rails between a completely closed normal switch position and a completely closed reverse switch position.

52. The method of claim 44 wherein the microprocessor measures frequency amplitude upon power up and uses resulting power up information to compensate for position of field generator sensors.

53. The method of claim 45 wherein the microprocessor measures frequency amplitude upon power up and uses resulting power up information to compensate for position of field generator sensors.

54. The method of claim 29 wherein frequency amplitude is continuously monitored and compared with power up information and the difference is used to determine dislocation or misalignment of sensors.

55. The method of claim 30 wherein frequency amplitude is continuously monitored and compared with power up information and the difference is used to determine dislocation or misalignment of sensors.

56. The method of claim 54 where a fail safe signal output is initiated by the microprocessor when a positive difference determined by subtracting the power up information from the monitored frequency amplitude exceeds a fail safe threshold level.

57. The method of claim 55 where a fail safe signal output is initiated by the microprocessor when a positive difference determined by subtracting the power up information from the monitored frequency amplitude exceeds a fail safe threshold level.

58. The method of claim 29 wherein four states of frequency amplitude corresponding to initial positive detection of the rail and at multiple different gap distances of a contact point from its corresponding rail are measured during movement of a contact point within the range of a field generator sensor.

59. The method of claim 58 wherein the multiple different gap distances are 0.1, 0.2, 0.3, 0.4 and 0.5 inch.

60. The method of claim 29 wherein the detector comprises a microprocessor and memory that can be programmed to contain threshold values determined by actual measurement of frequency amplitude at various positions of a contact point of a rail relative to location of a sensor.

* * * * *